US006430260B1

(12) United States Patent
Snyder

(10) Patent No.: US 6,430,260 B1
(45) Date of Patent: Aug. 6, 2002

(54) X-RAY TUBE ANODE COOLING DEVICE AND SYSTEMS INCORPORATING SAME

(75) Inventor: Douglas J. Snyder, Brookfield, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/752,014

(22) Filed: Dec. 29, 2000

(51) Int. Cl.[7] ..... H01J 35/10
(52) U.S. Cl. ..... 378/130; 378/141
(58) Field of Search ..... 378/130, 129, 378/125, 127, 144, 141

(56) References Cited

U.S. PATENT DOCUMENTS

| | | | | |
|---|---|---|---|---|
| 3,694,685 A | | 9/1972 | Houston | 313/60 |
| 4,165,472 A | | 8/1979 | Wittry | 313/35 |
| 4,455,504 A | | 6/1984 | Iversen | 313/30 |
| 4,622,687 A | | 11/1986 | Whitaker et al. | 378/130 |
| 4,674,109 A | | 6/1987 | Ono | 378/130 |
| 4,945,562 A | | 7/1990 | Staub | 378/130 |
| 4,969,172 A | | 11/1990 | Fengler et al. | 378/125 |
| 5,091,927 A | | 2/1992 | Golitzer et al. | 378/130 |
| 5,416,820 A | | 5/1995 | Weil et al. | 378/130 |
| 5,541,975 A | * | 7/1996 | Anderson et al. | 378/130 |
| 5,579,364 A | | 11/1996 | Osaka et al. | 378/130 |
| 5,652,778 A | | 7/1997 | Tekriwal | 378/132 |
| 5,673,301 A | | 9/1997 | Tekriwal | 378/130 |
| 5,995,584 A | | 11/1999 | Bhatt | 378/125 |
| 6,021,174 A | | 2/2000 | Campbell | 378/125 |

* cited by examiner

*Primary Examiner*—David P. Porta
(74) *Attorney, Agent, or Firm*—Kilpatrick Stockton LLP; Charles W. Calkins; Christopher L. Bernard

(57) ABSTRACT

An anode target for use within an x-ray generating device including a target frame having an inner surface and an outer surface and a thermal energy transfer device. The thermal energy transfer device including a heat exchanger having an inner surface and an outer surface, at least a portion of the outer surface of the heat exchanger positioned adjacent to at least a portion of the inner surface of the target frame; a cooling medium circulating through the heat exchanger for convectively cooling the anode target; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

57 Claims, 3 Drawing Sheets

X-RAY TUBE ANODE COOLING DEVICE AND SYSTEMS INCORPORATING SAME

BACKGROUND OF THE INVENTION

The present invention relates generally to a thermal energy transfer device for use within an x-ray generating device and, more specifically, to a convection cooled anode target for use within an x-ray tube.

Typically, an x-ray generating device, referred to as an x-ray tube, includes opposed electrodes enclosed within a cylindrical vacuum vessel. The vacuum vessel is commonly fabricated from glass or metal, such as stainless steel, copper, or a copper alloy. The electrodes include a cathode assembly positioned at some distance from the target track of a rotating, disc-shaped anode assembly. Alternatively, such as in industrial applications, the anode assembly may be stationary. The target track, or impact zone, of the anode is generally fabricated from a refractory metal with a high atomic number, such as tungsten or a tungsten alloy. Further, to accelerate electrons used to generate x-rays, a voltage difference of about 60 kV to about 140 kV is commonly maintained between the cathode and anode assemblies. The hot cathode filament emits thermal electrons that are accelerated across the potential difference, impacting the target zone of the anode assembly at high velocity. A small fraction of the kinetic energy of the electrons is converted to high-energy electromagnetic radiation, or x-rays, while the balance is contained in back-scattered electrons or converted to heat. The x-rays are emitted in all directions, emanating from a focal spot, and may be directed out of the vacuum vessel along a focal alignment path. In an x-ray tube having a metal vacuum vessel, for example, an x-ray transmissive window is fabricated into the vacuum vessel to allow an x-ray beam to exit at a desired location. After exiting the vacuum vessel, the x-rays are directed along the focal alignment path to penetrate an object, such as a human anatomical part for medical examination and diagnostic purposes. The x-rays transmitted through the object are intercepted by a detector or film, and an image of the internal anatomy of the object is formed. Likewise, industrial x-ray tubes may be used, for example, to inspect metal parts for cracks or to inspect the contents of luggage at an airport.

Since the production of x-rays in a medical diagnostic x-ray tube is by its very nature an inefficient process, the components in the x-ray tube operate at elevated temperatures. For example, the temperature of the anode's focal spot may run as high as about 2,700 degrees C., while the temperature in other parts of the anode may run as high as about 1,800 degrees C. The thermal energy generated during tube operation is typically transferred from the anode, and other components, to the vacuum vessel. The vacuum vessel, in turn, is generally enclosed in a casing filled with a circulating cooling fluid, such as dielectric oil or air, that removes the thermal energy from the x-ray tube. The casing also supports and protects the x-ray tube and provides a structure for mounting the tube. Additionally, the casing is commonly lined with lead to shield stray radiation.

As discussed above, the primary electron beam generated by the cathode of an x-ray tube deposits a large heat load in the anode target. In fact, the target glows red-hot in operation. Typically, less than 1% of the primary electron beam energy is converted into x-rays, the balance being converted to thermal energy. This thermal energy from the hot target is conducted and radiated to other components within the vacuum vessel. The fluid circulating around the exterior of the vacuum vessel transfers some of this thermal energy out of the system. However, the high temperatures caused by this thermal energy subject the x-ray tube components to high thermal stresses that are problematic in the operation and reliability of the x-ray tube. This is true for a number of reasons. First, the exposure of components in the x-ray tube to cyclic high temperatures may decrease the life and reliability of the components. In particular, the anode assembly is subject to thermal growth and target burst. The anode assembly also typically includes a shaft that is rotatably supported by a bearing assembly. The bearing assembly is very sensitive to high heat loads. Overheating of the bearing assembly may lead to increased friction, increased noise, and to the ultimate failure of the bearing assembly. Due to the high temperatures present, the balls of the bearing assembly are typically coated with a solid lubricant. A preferred lubricant is lead, however, lead has a low melting point and is typically not used in a bearing assembly exposed to operating temperatures above about 330 degrees C. Because of this temperature limit, an x-ray tube with a bearing assembly including a lead lubricant is limited to shorter, less powerful x-ray exposures. Above about 450 degrees C., silver is generally the lubricant of choice, allowing for longer, more powerful x-ray exposures. Silver, however, increases the noise generated by the bearing assembly.

The high temperatures encountered within an x-ray tube also reduce the scanning performance or throughput of the tube, which is a function of the maximum operating temperature, and specifically the anode target and bearing temperatures, of the tube. As discussed above, the maximum operating temperature of an x-ray tube is a function of the power and length of x-ray exposure, as well as the time between x-ray exposures. Typically, an x-ray tube is designed to operate at a certain maximum temperature, corresponding to a certain heat capacity and a certain heat dissipation capability for the components within the tube. These limits are generally established with current x-ray routines in mind. However, new routines are continually being developed, routines that may push the limits of existing x-ray tube capabilities. Techniques utilizing higher power, longer x-ray exposures, and increased patient throughput are in demand to provide better images and greater patient care. This is especially true with respect to computed tomography (CT) systems. Thus, there is a need to remove as much heat as possible from existing x-ray tubes, as quickly as possible, in order to increase x-ray exposure power and duration before reaching tube operational limits.

The prior art has primarily relied upon removing thermal energy from the x-ray tube target by radiating heat from the target to the vacuum vessel wall and then transferring this heat to the cooling fluid circulating around the vacuum vessel. It has also relied upon increasing the diameter and mass of the anode target in order to increase the heat storage capability and radiating surface area of the target. These approaches have been marginally effective, however they are limited. The cooling fluid methods, for example, are not adequate when the anode end of the x-ray tube cannot be sufficiently exposed to the circulating fluid. This is a common problem in x-ray tubes having mounting and adjustment mechanisms. Other cooling fluid methods have sought to aid in the removal of heat from the x-ray tube by circulating fluid through multiple hollow chambers in the shaft of the anode assembly. These methods too are typically limited to hard-mounted x-ray tubes. Likewise, the target modification methods are generally not adequate as the potential diameter of the anode target is ultimately limited by space constraints on the scanning system, especially when enhanced x-ray system angulation capability is desired. Further, a finite amount of time is required for heat to be conducted from the target track, where the electron beam actually hits the anode target, to other regions of the target. In fact, thermal energy may not even reach the back of the target until a given scan has ended. Thus, adding extra mass to the back of the target provides little thermal performance benefit.

Therefore, what is needed are devices providing enhanced anode target heat dissipation, thus enabling lower target track and bulk temperatures, enabling higher peak power for a given x-ray tube rotor speed, reducing the risk of target burst, and allowing longer and more powerful x-ray scans. What is also needed are devices providing smaller targets with lower target mass for a given power rating, for example, decreasing the bearing load on CT tubes, enabling higher CT system gantry speeds, and allowing better x-ray system angulation.

BRIEF SUMMARY OF THE INVENTION

The present invention overcomes the aforementioned problems and permits greater x-ray tube throughput by providing a cooler anode target. The present invention also reduces thermal growth of the anode target, improving image quality and allowing for the simplification of CT system design. Further, the present invention increases the life of x-ray tube components.

In one embodiment, an anode assembly for use within an x-ray generating device includes a target frame having an inner surface and an outer surface; a heat exchanger having an inner surface and an outer surface, at least a portion of the outer surface of the heat exchanger positioned adjacent to at least a portion of the inner surface of the target frame; and a thermal coupling medium disposed between the inner surface of the target frame and the outer surface of the heat exchanger, the thermal coupling medium thermally coupling the target frame with the heat exchanger.

In another embodiment, a thermal energy transfer device for use within a target of an anode assembly of an x-ray generating device includes a heat exchanger having an inner surface and an outer surface, at least a portion of the outer surface of the heat exchanger positioned adjacent to at least a portion of an inner surface of a target frame of the anode target; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

In a further embodiment, an x-ray generating device that generates x-rays and residual energy in the form of heat includes, a vacuum vessel having an inner surface forming a vacuum chamber; an anode assembly disposed with the vacuum chamber, the anode assembly including a target having a target frame with an inner surface and an outer surface; a cathode assembly disposed within the vacuum chamber at a distance from the anode assembly, the cathode assembly configured to emit electrons that strike the target, producing x-rays and residual energy; a heat exchanger having an inner surface and an outer surface, at least a portion of the outer surface of the heat exchanger positioned adjacent to and in a spaced apart relationship with at least a portion of the inner surface of the target frame; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

DETAILED DESCRIPTION OF THE INVENTION

The present invention seeks to remove excess thermal energy from an x-ray tube or x-ray system by positioning a heat exchanger and a thermal coupling medium within the anode target of the x-ray tube. This thermal energy transfer device convectively cools the anode target, increasing the life and efficiency of the x-ray tube or x-ray system.

Figure 1:
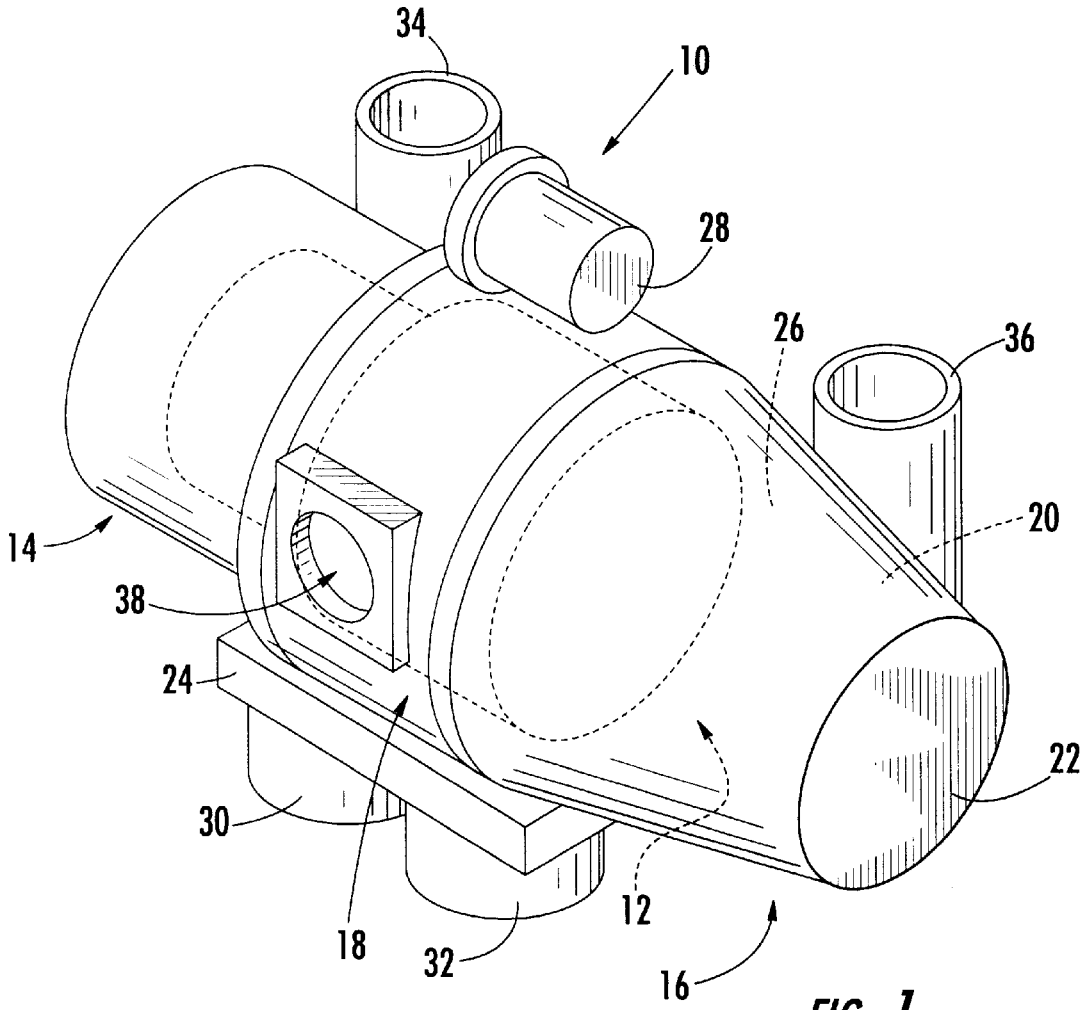
FIG. 1 is a perspective view of an x-ray tube assembly unit that contains an x-ray generating device, or x-ray tube.

Referring to FIG. 1, an x-ray tube assembly unit 10 that contains an x-ray generating device, or x-ray tube 12, includes an anode end 14, a cathode end 16, and a center section 18 positioned between the anode end 14 and the cathode end 16. The x-ray tube 12 is disposed within the center section 18 of the assembly unit 10 in a fluid-filled chamber 20 formed by a casing 22. The casing 22 may, for example, be made of aluminum. The chamber 20 may, for example, be filled with dielectric oil that circulates throughout the casing 22, cooling the operational x-ray tube 12 and insulating the casing 22 from the high electrical charges within the x-ray tube 12. The casing 22 may, optionally, be lead-lined. The assembly unit 10 also, preferably, includes a radiator 24, positioned to one side of the center section 18, that cools the circulating fluid 26. The fluid 26 may be moved through the chamber 20 and radiator 24 by an appropriate pump 28, such as an oil pump. Preferably, a pair of fans 30, 32 are coupled to the radiator 24, providing a cooling air flow to the radiator 24 as the hot fluid 26 flows through it. Electrical connections to the assembly unit 10 are provided through an optional anode receptacle 34 and a cathode receptacle 36. X-rays are emitted from the x-ray tube assembly unit 10 through an x-ray transmissive window 38 in the casing 22 at the center section 18.

Figure 2:
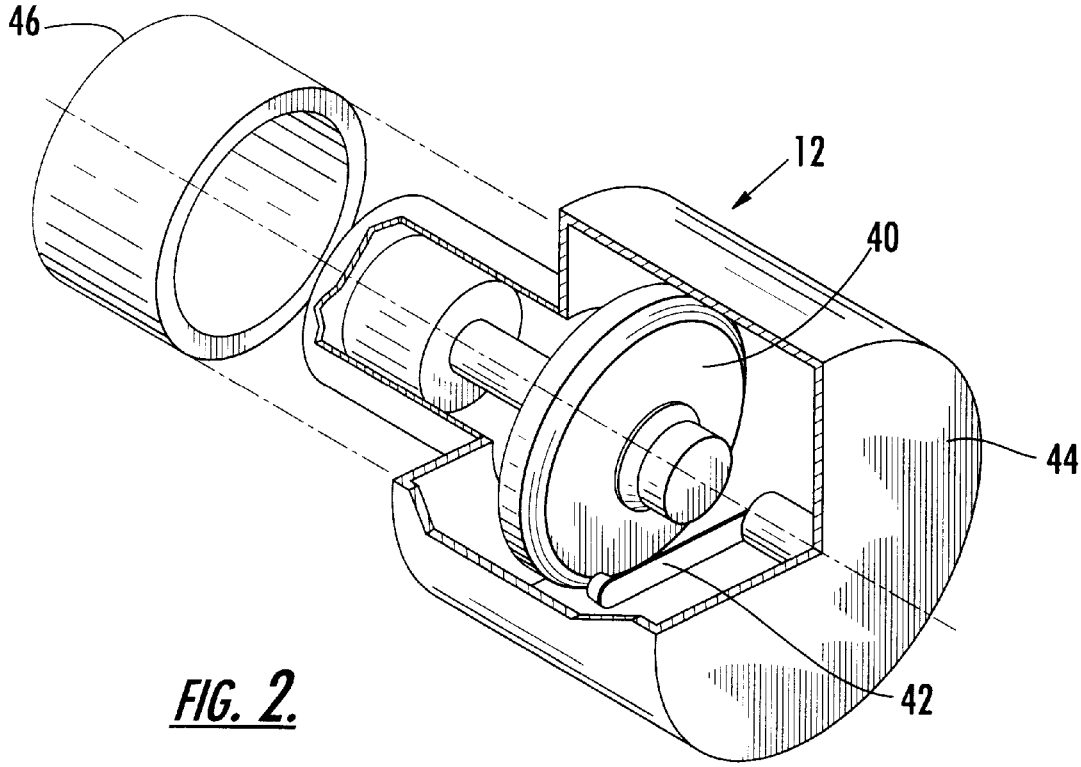
FIG. 2 is a sectional perspective view of an x-ray tube with the stator exploded to reveal a portion of the anode assembly.

Referring to FIG. 2, an x-ray generating device, or x-ray tube 12, includes an anode assembly 40 and a cathode assembly 42 disposed within a vacuum vessel 44. The vacuum vessel 44 may, for example, be made of stainless steel, copper, or glass. The anode assembly 40 may optionally, for medical applications, be rotating. A stator 46 is positioned over the vacuum vessel 44 adjacent to the anode assembly 40. Upon the energization of an electrical circuit connecting the anode assembly 40 and the cathode assembly 42, which produces a potential difference of about 60 kV to about 140 kV between the anode assembly 40 and the cathode assembly 42, electrons are directed from the cathode assembly 42 to the anode assembly 40. The electrons strike a focal spot located within a target zone of the anode assembly 40 and produce high-frequency electromagnetic waves, or x-rays, back-scattered electrons, and residual energy. The residual energy is absorbed by the components within the x-ray tube 12 as heat. The x-rays are directed through the vacuum existing within the vacuum chamber 44 and out of the casing 22 (FIG. 1) through the transmissive window 38 (FIG. 1), toward an object to be imaged, along a focal alignment path. The transmissive window 38 may be made of beryllium, titanium, aluminum, or any other suitable x-ray transmissive material. The transmissive window 38, and optionally an associated aperture and/or filter, collimates the x-rays, thereby reducing the radiation dosage received by, for example, a patient. As an illustration, in CT applications, the useful diagnostic energy range for x-rays is from about 60 keV to about 140 keV. An x-ray system utilizing an x-ray tube 12 may also be used for mammography, radiography, angiography, fluoroscopy, vascular, mobile, and industrial x-ray applications, among others.

Figure 3:
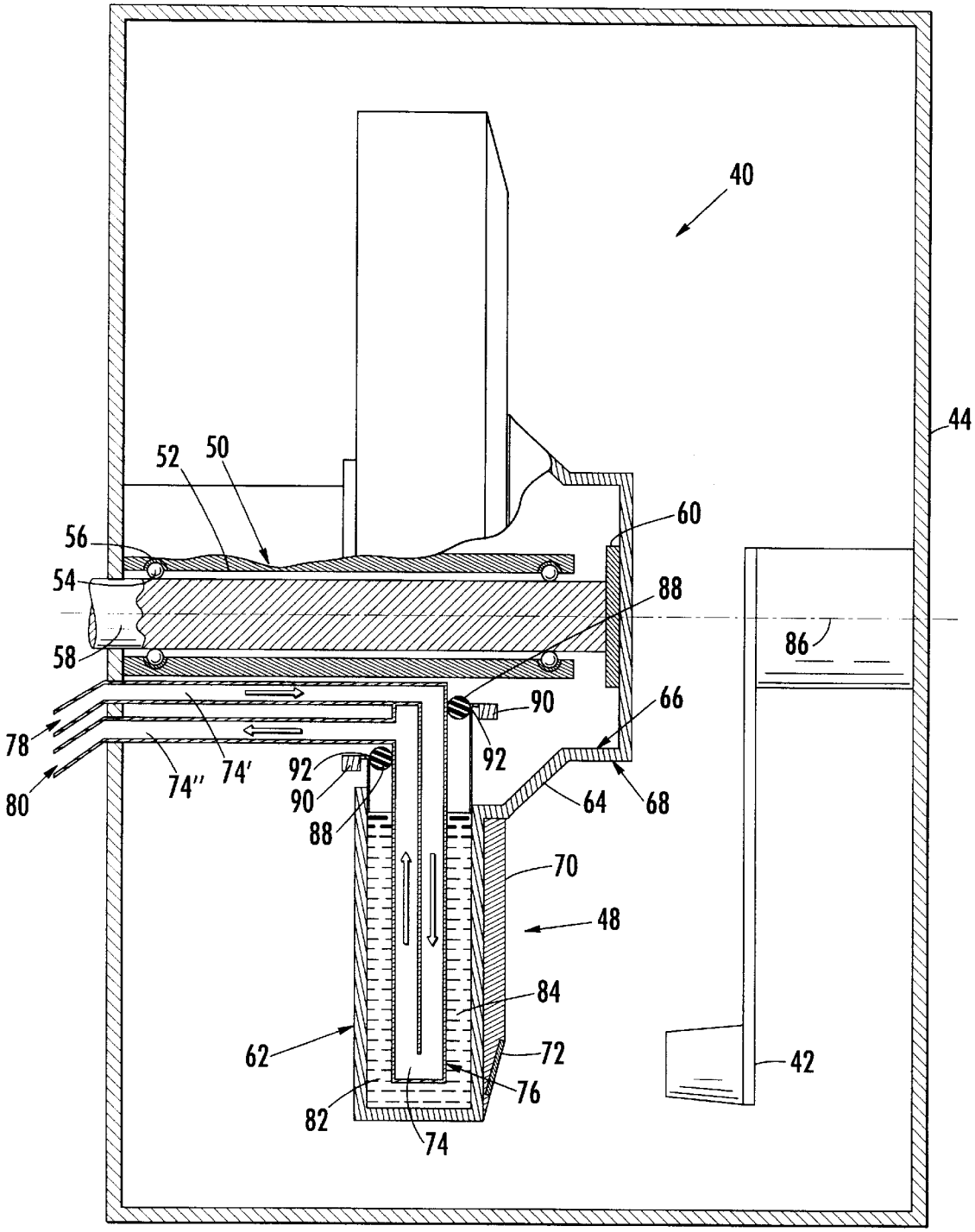
FIG. 3 is a partial cross-sectional view of an anode assembly of an x-ray tube including the thermal energy transfer device of the present invention.

Referring to FIG. 3, an anode assembly 40 of an x-ray tube 12 (FIGS. 1 and 2) typically includes a target 48 and a bearing assembly 50. The bearing assembly 50 includes a bearing support 52, bearings balls 54, and bearing races 56. The target 48 is a metallic disk made of a refractory metal, optionally with graphite brazed to it. The target 48 is preferably fabricated from a refractory metal with a high atomic number, such as tungsten or a tungsten alloy. The target 48 provides a surface that electrons from the cathode assembly 42 strike, producing x-rays and residual thermal energy. Optionally, the target 48 rotates by the rotation of a shaft 58 coupled to the target 48 by a connector 60. The rotation of the target 48 distributes the area of the target 48 that is impacted by electrons. The bearing support 52 is a cylindrical tube that provides support for the anode assembly 40. Bearing balls 54 and bearing races 56 are disposed within the bearing support 52 and provide for rotational movement of the target 48 by providing for rotational movement of the shaft 58. The bearing balls 54 and bearing races 56 are typically made of tool steel or another suitable metal and may become softened and even deformed by excessive heat. As a result, distributing heat away from the target 48, bearing balls 54, and bearing races 56 is important to the proper rotational movement of the anode assembly 40 and, therefore, the proper operation of the x-ray tube 12.

As discussed above, the primary electron beam generated by the cathode assembly 42 of an x-ray tube 12 deposits a large heat load in the target 48. In fact, the target 48 glows red-hot in operation. Typically, less than 1% of the primary electron beam energy is converted into x-rays, the balance being converted to thermal energy. This thermal energy from the hot target 48 is conducted and radiated to other components within the vacuum vessel 44. The fluid 26 (FIG. 1) circulating around the exterior of the vacuum vessel 44 transfers some of this thermal energy out of the system. However, the high temperatures caused by this energy subject the x-ray tube 12 and its components to high thermal stresses that are problematic in the operation and reliability of the x-ray tube 12 and that reduce its throughput.

Referring again to FIG. 3, the target 48 of the anode assembly 40 includes one embodiment of a thermal energy transfer device 62. The target 48 includes a target frame 64 having an inner surface 66 and an outer surface 68. The target frame 64 may include radially and axially extending portions that form an annular chamber within which a heat exchanger 74 and thermal coupling medium 84 are disposed. The target frame 64 may also include radially and axially extending portions that partially form an annular chamber adjacent to which the heat exchanger 74 and the thermal coupling medium 84 are positioned. Alternatively, the target frame 64 may include a single radially extending portion adjacent to which the heat exchanger 74 and the thermal coupling medium 84 are positioned. The target 48 may further include a target body 70 and a target track 72. The target frame 64, target body 70, and target track 72 are preferably annular structures. Optionally, the target frame 64, target body 70, and target track 72 may be integrally formed. The target frame 64 is commonly made of a molybdenum alloy or other suitable material. The target body 70 is commonly made of graphite and is fixedly attached to the outer surface 68 of the target frame 64. The target track 72 is fixedly attached to a portion of the target body 70 such that it may be struck by electrons emitted by the cathode assembly 42, producing x-rays and generating residual thermal energy. The target track 72 is preferably made of a refractory metal with a high atomic number, such as tungsten or a tungsten alloy. For medical applications, for example, the target frame 64, target body 70, and target track 72 preferably rotate with the rotation of the shaft 58. Additionally, the target frame 64, target body 70, or integrally formed target 48 may be hollow and filled with a liquid/vapor phase change material to augment heat transfer. This may be referred to as a vapor chamber design.

The heat exchanger 74 is a hollow chamber or channel positioned adjacent to, and preferably in a spaced apart relationship with, at least a portion of the inner surface 66 of the target frame 64. The heat exchanger 74 is also preferably an annular structure and all or a portion of the outer surface 76 of the heat exchanger 74 may be positioned adjacent to the inner surface 66 of the target frame 64. The walls of the heat exchanger 74 may be made of, for example, stainless steel, molybdenum, or any other suitable alloy or material. The heat exchanger 74 has an inlet 78 fluidly coupled to an inlet portion 74' of the heat exchanger 74 and an outlet 80 fluidly coupled to an outlet portion 74" of the heat exchanger 74. The inlet portion 74' and outlet portion 74" of the heat exchanger 74 are fluidly coupled annular chambers that are at least partially separated by a common wall. The inlet portion 74' may extend axially, positioned adjacent to the bearing support 52. Additionally, the inlet portion 74' may extend radially from the bearing support 52 along the target frame 64, adjacent to the target frame 64 and target body 70. The outlet portion 74" extends radially inward from the end of the inlet portion 74' and axially away from the target 48, adjacent to the inlet portion 74'. A cooling medium 82, such as water, oil, glycol, or any other suitable coolant, is circulated through the heat exchanger 74 from the inlet portion 74' to the outlet portion 74", convectively cooling the anode target 48 and bearing assembly 50. The cooling medium 82 may be pumped to the heat exchanger 74 from inside or outside of the casing 22 (FIG. 1). Convective cooling of the anode target 48 may be maximized by maximizing the portion of the inner surface 66 of the target frame 64 that is exposed to the outer surface 76 of the heat exchanger 74. The heat exchanger 74 preferably does not rotate.

The thermal coupling medium 84 is disposed in the gap formed by the inner surface 66 of the target frame 64 and the outer surface 76 of the heat exchanger 74, thermally coupling the heat exchanger 74 with the target frame 64 yet allowing relative motion between the target frame 64 and the heat exchanger 74. The thermal coupling medium 84 is preferably a liquid metal and may be, for example, a gallium alloy. The thermal coupling medium 84 is preferably a fluid with a high thermal conductivity. Preferably, the gap or channel formed by the inner surface 66 of the target frame 64 and the outer surface 76 of the heat exchanger 74, which may range from about 0.01 mm to about 5 mm, and more preferably from about 0.1 mm to about 3 mm, is only partially filled with the thermal coupling medium 84, allowing the medium 84 to centrifuge outward, away from the axis of rotation 86 of the anode target 48, as the anode target 48 rotates. The thermal coupling medium 84 may, however, fill the entire gap. The thermal coupling medium 84 is prevented from exiting the gap between the inner surface 66 of the target frame 64 and the outer surface 76 of the heat exchanger 74 by one or more seals 88. The seal(s) 88 may be, for example, lip seals, point seals, linear seals, annular rings, or o-rings. To prevent excessive wear of the seal(s) 88 during anode target 48 rotation, a counterweight 90 and lever 92 may be fixedly attached to each seal 88. Alternatively, counterweights 90 and levers 92 may be fixedly attached to the anode target 48 such that each lever is biased into contacting each seal 88. Each lever 92 extends radially inward from the target frame 64 to contact each seal 88, then extends axially away from the seal 88 to an end where the counterweight 90 is mounted. Alternatively, the levers 92 may include a diaphragm structure. As the stationary target 48 begins to rotate, the centrifugal force acting on the masses or counterweights 90 unloads the seal(s) 88, prolonging their life. As the target assembly 48 ceases to rotate, the centrifugal force subsides and the seal(s) 88 are again loaded, preventing the thermal coupling medium 84 from leaking from the gap formed by the inner surface 66 of the target frame 64 and the outer surface 76 of the cooling frame 74. Suitable materials for the levers 92 include, for example, stainless steel, molybdenum, or any other material that is compatible with the thermal coupling medium 84. Alternatively, solenoid devices may also be used to disengage the seal(s) 88 when the target 48 begins to spin above a predetermined rotational speed and re-engage the seal(s) 88 when the target 48 slows to a predetermined rotational speed.

The thermal energy transfer device 62, described above, increases the ability of an x-ray tube 12 (FIGS. 1 and 2) to perform longer and more powerful x-ray scans. The device 62 reduces the thermal energy present in an x-ray tube 12, increasing steady state performance by 5 times, or more, as compared to traditional x-ray tubes 12. The enhanced anode target 48 heat dissipation and lower target track 72 temperature provided by the thermal energy transfer device 62 reduces the risk of target 48 burst and allows smaller targets 48 with lower masses for a given power rating to be utilized, for example, decreasing the bearing load on CT tubes, enabling higher CT system gantry speeds, and allowing better x-ray system angulation.

Although the present invention has been described with reference to preferred embodiments, other embodiments may achieve the same results. Variations in and modifications to the present invention will be apparent to those skilled in the art and the following claims are intended to cover all such equivalents.

What is claimed is:

1. An anode assembly for use within an x-ray generating device, the anode assembly comprising:

a target frame having an inner surface and an outer surface;

a rotatable shaft coupled to the target frame;

a bearing assembly for supporting the rotatable shaft;

a heat exchanger having an inner surface and an outer surface, the heat exchanger comprising a cooling medium circulating through the heat exchanger for convectively cooling the anode assembly, at least a portion of the outer surface of the heat exchanger positioned adjacent to at least a portion of the inner surface of the target frame and at least a portion of the outer surface of the heat exchanger positioned adjacent to at least a portion of the rotatable shaft and the bearing assembly; and a thermal coupling medium disposed between the inner surface of the target frame and the outer surface of the heat exchanger, the thermal coupling medium thermally coupling the target frame with the heat exchanger.

2. The anode assembly of claim 1, wherein the target frame is rotatable relative to the heat exchanger.

3. The anode assembly of claim 1, wherein the heat exchanger and the thermal coupling medium increase the steady state performance of the anode assembly at a given operating temperature by at least 5 times over anode assemblies without the heat exchanger and the thermal coupling medium.

4. The anode assembly of claim 1, wherein the cooling medium comprises a medium selected from the group consisting of air, water, glycol, oil, and coolant.

5. The anode assembly of claim 1, wherein the thermal coupling medium permits relative motion between the target frame and the heat exchanger.

6. The anode assembly of claim 1, wherein the thermal coupling medium comprises a liquid metal.

7. The anode assembly of claim 1, wherein the thermal coupling medium comprises a gallium alloy.

8. The anode assembly of claim 2, wherein at least a portion of the inner surface of the target frame and at least a portion of the outer surface of the heat exchanger form a channel having at least one opening.

9. The anode assembly of claim 8, further comprising at least one sealing assembly for sealingly closing the at least one opening.

10. The anode assembly of claim 9, wherein the at least one sealing assembly comprises a seal engaged with a lever and a counterweight for sealingly closing the at least one opening.

11. The anode assembly of claim 9, wherein the at least one sealing assembly comprises a solenoid device for sealingly closing the at least one opening when the rotational speed of the target frame is reduced to a predetermined level.

12. The anode assembly of claim 1, wherein the anode assembly further comprises a target body fixedly attached to at least a portion of the outer surface of the target frame.

13. The anode assembly of claim 12, wherein the target body further comprises a target track fixedly attached to at least a portion of the target body, the target track for receiving electrons and producing x-rays.

14. The anode assembly of claim 12, wherein the target body comprises graphite, a molybdenum alloy, or a tungsten alloy.

15. The anode assembly of claim 13, wherein the target track comprises a refractory metal with a high atomic number.

16. The anode assembly of claim 13, wherein the target track comprises tungsten or a tungsten alloy.

17. An anode assembly for use within an x-ray generating device, the anode assembly comprising:

an annular target frame having an inner surface and an outer surface;

a rotatable shaft coupled to the target frame;

a bearing assembly for supporting the rotatable shaft;

an annular heat exchanger having an inner surface and an outer surface, the heat exchanger comprising a cooling medium circulating through the heat exchanger for convectively cooling the anode assembly, at least a portion of the outer surface of the heat exchanger positioned adjacent to at least a portion of the inner surface of the target frame and at least a portion of the outer surface of the heat exchanger positioned adjacent to at least a portion of the rotatable shaft and the bearing assembly; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

18. The anode assembly of claim 17, wherein the target frame is rotatable relative to the heat exchanger.

19. The anode assembly of claim 17, wherein the cooling medium comprises a medium selected from the group consisting of air, water, glycol, and oil.

20. The anode assembly of claim 17, wherein the thermal coupling medium comprises a liquid metal.

21. The anode assembly of claim 20, wherein the thermal coupling medium comprises a gallium alloy.

22. The anode assembly of claim 18, wherein at least a portion of the inner surface of the target frame and at least a portion of the outer surface of the heat exchanger form a channel having at least one opening.

23. The anode assembly of claim 22, further comprising at least one sealing assembly for sealingly closing the at least one opening when the rotational speed of the target frame is reduced to a predetermined level.

24. The anode assembly of claim 23, wherein the at least one sealing assembly comprises a seal engaged with a lever and a counterweight for sealingly closing the at least one opening.

25. The anode assembly of claim 23, wherein the at least one sealing assembly comprises a solenoid device for sealingly closing the at least one opening when the rotational speed of the target frame is reduced to a predetermined level.

26. The anode assembly of claim 17, wherein the heat exchanger and the thermal coupling medium increase the steady state performance of the anode assembly at a given operating temperature by at least 5 times over anode assemblies without the heat exchanger and the thermal coupling medium.

27. A thermal energy transfer device for use within a target of an anode assembly of an x-ray generating device comprising a rotatable shaft coupled to the target and a bearing assembly for supporting the rotatable shaft, the thermal energy transfer device comprising:

a heat exchanger having an inner surface and an outer surface, the heat exchanger comprising a cooling medium circulating through the heat exchanger for convectively cooling the anode assembly, at least a portion of the outer surface of the heat exchanger positioned adjacent to at least a portion of an inner surface of a target frame of the anode target and at least a portion of the outer surface of the heat exchanger positioned adjacent to at least a portion of the rotatable shaft and the bearing assembly; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

28. The thermal energy transfer device of claim 27, wherein the thermal coupling medium comprises a liquid metal.

29. The thermal energy transfer device of claim 27, wherein the thermal coupling medium comprises a gallium alloy.

30. The thermal energy transfer device of claim 27, wherein the target frame is rotatable relative to the heat exchanger.

31. The thermal energy transfer device of claim 27, wherein the heat exchanger and the target frame are in a spaced apart relationship.

32. The thermal energy transfer device of claim 30, wherein at least a portion of the inner surface of the target frame and at least a portion of the outer surface of the heat exchanger form a channel having at least one opening.

33. The thermal energy transfer device of claim 32, further comprising at least one sealing assembly for sealingly closing the at least one opening.

34. The thermal energy transfer device of claim 33, wherein the at least one sealing assembly comprises a seal engaged with a lever and a counterweight for sealingly closing the at least one opening.

35. The thermal energy transfer device of claim 33, wherein the at least one sealing assembly comprises a solenoid device for sealingly closing the at least one opening when the rotational speed of the target frame is reduced to a predetermined level.

36. The thermal energy transfer device of claim 27, wherein the thermal energy transfer device increases the steady state performance of the x-ray generating device at a given operating temperature by at least 5 times over x-ray generating devices without the thermal energy transfer device.

37. The thermal energy transfer device of claim 27, wherein the cooling medium comprises a medium selected from the group consisting of air, water, glycol, and oil.

38. A thermal energy transfer device for use within a target of an anode assembly of an x-ray generating device comprising a rotatable shaft coupled to the target and a bearing assembly for supporting the rotatable shaft, the thermal energy transfer device comprising:

an annular heat exchanger having an inner surface and an outer surface, the heat exchanger comprising a cooling medium circulating through the heat exchanger for convectively cooling the anode assembly, at least a portion of the outer surface of the heat exchanger positioned adjacent to at least a portion of an inner surface of an annular target frame of the anode target and at least a portion of the outer surface of the heat exchanger positioned adjacent to at least a portion of the rotatable shaft and the bearing assembly; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

39. The thermal energy transfer device of claim 38, wherein the cooling medium comprises a medium selected from the group consisting of air, water, glycol, and oil.

40. The thermal energy transfer device of claim 38, wherein the thermal coupling medium comprises a liquid metal.

41. The thermal energy transfer device of claim 40, wherein the thermal coupling medium comprises a gallium alloy.

42. The thermal energy transfer device of claim 38, wherein the target frame is rotatable relative to the heat exchanger.

43. The thermal energy transfer device of claim 38, wherein the heat exchanger and the target frame are in a spaced apart relationship.

44. The thermal energy transfer device of claim 42, wherein at least a portion of the inner surface of the target frame and at least a portion of the outer surface of the heat exchanger form a channel having at least one opening.

45. The thermal energy transfer device of claim 44, further comprising at least one sealing assembly for sealingly closing the at least one opening.

46. The thermal energy transfer device of claim 45, wherein the at least one sealing assembly comprises a seal engaged with a lever and a counterweight for sealingly closing the at least one opening.

47. The thermal energy transfer device of claim 45, wherein the at least one sealing assembly comprises a solenoid device for sealingly closing the at least one opening when the rotational speed of the target frame is reduced to a predetermined level.

48. An x-ray generating device that generates x-rays and residual energy in the form of heat, the x-ray generating device comprising:

a vacuum vessel having an inner surface forming a vacuum chamber;

an anode assembly disposed with the vacuum chamber, the anode assembly including a target having a target frame with an inner surface and an outer surface;

a rotatable shaft coupled to the vacuum vessel;

a bearing assembly for supporting the anode assembly;

a cathode assembly disposed within the vacuum chamber at a distance from the anode assembly, the cathode assembly configured to emit electrons that strike the target, producing x-rays and residual energy;

a heat exchanger having an inner surface and an outer surface, the heat exchanger comprising a cooling medium circulating through the heat exchanger for convectively cooling the anode assembly, at least a portion of the outer surface of the heat exchanger positioned adjacent to and in a spaced apart relationship with at least a portion of the inner surface of the target frame and at least a portion of the outer surface of the heat exchanger positioned adjacent to at least a portion of the rotatable shaft and the bearing assembly; and a thermal coupling medium disposed between the inner surface of the target frame and the outer surface of the heat exchanger, the thermal coupling medium thermally coupling the target frame with the heat exchanger while permitting relative motion between the target frame and the heat exchanger.

49. The x-ray generating device of claim 48, wherein the target frame is rotatable relative to the heat exchanger.

50. The x-ray generating device of claim 49, wherein at least a portion of the inner surface of the target frame and at least a portion of the outer surface of the heat exchanger form a channel having at least one opening.

51. The x-ray generating device of claim 50, further comprising at least one sealing assembly for sealingly closing the at least one opening.

52. The x-ray generating device of claim 51, wherein the at least one sealing assembly comprises a seal engaged with a lever and a counterweight for sealingly closing the at least one opening.

53. The x-ray generating device of claim 51, wherein the at least one sealing assembly comprises a solenoid device for sealingly closing the at least one opening when the rotational speed of the target frame is reduced to a predetermined level.

54. The x-ray generating device of claim 48, wherein the cooling medium comprises a medium selected from the group consisting of air, water, glycol, and oil.

55. The x-ray generating device of claim 48, wherein the thermal coupling medium comprises a liquid metal.

56. The x-ray generating device of claim 48, wherein the thermal coupling medium comprises a gallium alloy.

57. The x-ray generating device of claim 48, wherein the heat exchanger and the thermal coupling medium increase the steady state performance of the x-ray generating device at a given operating temperature by at least 5 times over x-ray generating devices without the heat exchanger and the thermal coupling medium.

* * * * *